US005316493A

United States Patent [19]

Sowers

[11] Patent Number: 5,316,493

[45] Date of Patent: May 31, 1994

[54] ELECTRIC CORD PLUG FASTENER AND METHOD

[75] Inventor: David A. Sowers, Coral Springs, Fla.

[73] Assignee: BSD Enterprises, Inc., Coral Springs, Fla.

[21] Appl. No.: 741,730

[22] Filed: Aug. 7, 1991

[51] Int. Cl.[5] ..... H01R 4/50

[52] U.S. Cl. ..... 439/346; 439/148

[58] Field of Search ..... 439/269, 270, 147, 296, 439/148, 345, 346, 347

[56] References Cited

U.S. PATENT DOCUMENTS

| | | | |
|---|---|---|---|
| 2,408,551 | 10/1946 | Frank | 439/346 |
| 3,475,716 | 10/1969 | Laig . | |
| 3,489,989 | 1/1970 | Robaczewski | 439/346 |
| 3,989,334 | 11/1976 | Fortino | 439/148 |
| 4,061,409 | 12/1977 | Bealmear | 439/346 |
| 4,097,105 | 6/1978 | Zumwalt . | |
| 4,221,449 | 9/1980 | Schugart . | |
| 4,440,465 | 4/1984 | Elliot . | |
| 4,596,430 | 6/1986 | Olson . | |
| 4,690,476 | 9/1987 | Morgenrath . | |
| 4,773,874 | 9/1988 | Kopeski | 439/369 |
| 4,784,611 | 11/1988 | Poulin et al. | 439/346 |
| 4,925,396 | 5/1990 | Grover | 439/346 X |

FOREIGN PATENT DOCUMENTS

| | | | |
|---|---|---|---|
| 0935829 | 9/1963 | United Kingdom | 439/148 |

*Primary Examiner*—Larry I. Schwartz
*Assistant Examiner*—Khiem Nguyen
*Attorney, Agent, or Firm*—Frank L. Kubler

[57] ABSTRACT

A female electric cord plug or wall outlet is provided for fastening to a male electric cord plug having at least one prong, where the at least one prong has a longitudinal axis and at least one dent, including at least one prong receiving opening having a longitudinal axis along which the prong receiving opening receives the at least one prong, a prong engaging mechanism in the form of at least one dent engaging member which can enter the prong member can exit the prong receiving opening and disengage the dent and where the dent engaging member includes a shaft positioned essentially perpendicular to the longitudinal axis of the prong receiving opening and a cantilever structure having two ends and attached at one end to the shaft to protrude laterally from the shaft, the shaft being positioned to pass adjacent to the prong receiving opening, the shaft being slidable relative to the prong receiving opening such that the laterally protruding cantilever structure enters and exits the prong receiving opening to engage and disengage the dent by sliding the shaft.

35 Claims, 5 Drawing Sheets

FIG. 5
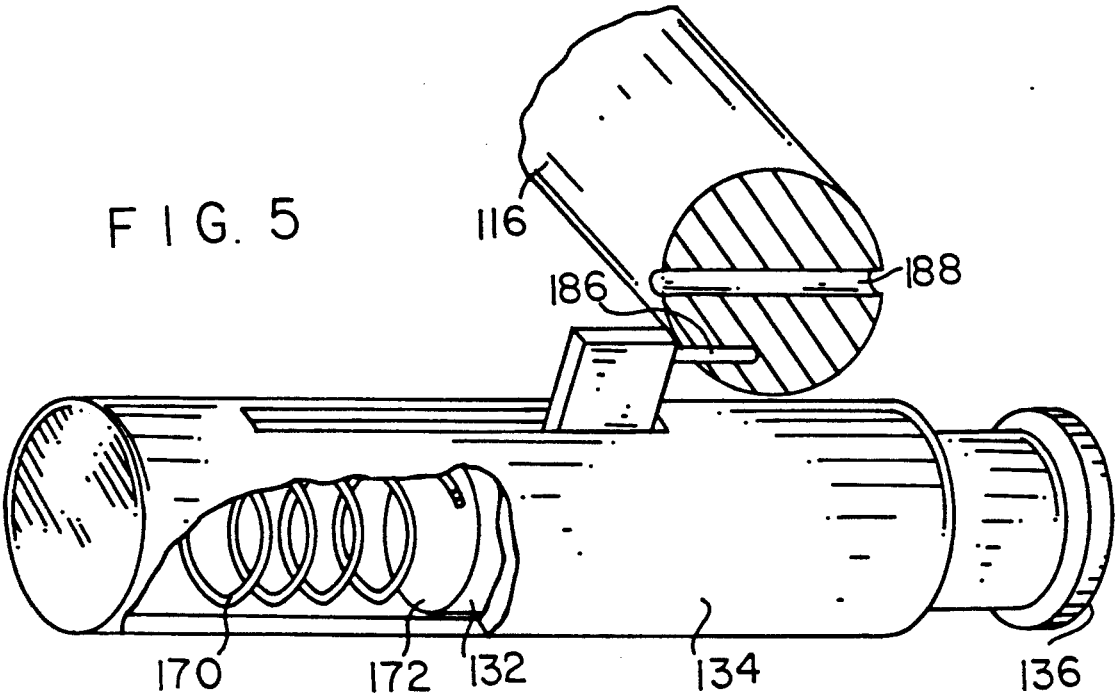
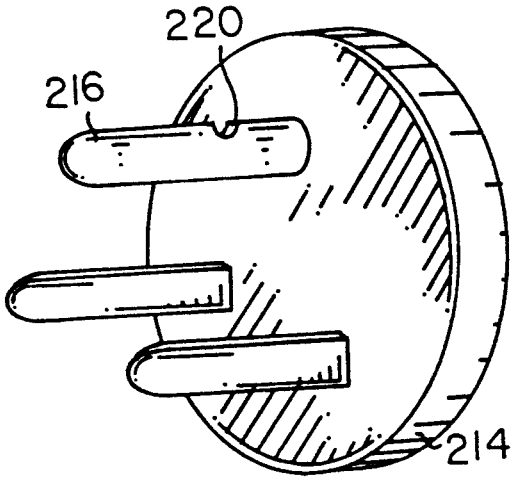
FIG. 7

ELECTRIC CORD PLUG FASTENER AND METHOD

BACKGROUND OF THE INVENTION

1. Field of the Invention

The present invention relates generally to the field of devices for joining the plug of an electric cord to the plug on another cord or to an outlet, and more specifically to a device attached to a female electric cord plug or wall outlet which engages at least one of the prongs of a male electric cord plug.

2. Description of the Prior Art

Once fitted together, most electric cord plug ends in the United States at present remain engaged to each other or to an outlet only because of a weak friction grip on the projecting terminal prongs, exerted by the receptacle. This friction grip often proves to be inadequate to keep the cords from separating during normal use. When a power tool cord is connected to an extension cord, for example, such cords are often bumped or pulled taut during ordinary use, causing unwanted disengagement from the power source.

In recognition of this problem, a variety of devices for joining together male and female electric cord plugs have been developed. These have included perforated straps fitted over studs on plug ends and tying cords and clip-on gripping devices. These devices are generally awkward to use, have separate parts which can be lost and do not achieve a fully secure engagement.

It is thus an object of the present invention to provide a plug fastening device which has no separate parts which can be lost.

It is another object of the present invention to provide such a device which is easy to use and yet solid and reliable.

It is finally an object of the present invention to provide such a device which is simple in construction and inexpensive.

SUMMARY OF THE INVENTION

The present invention accomplishes the above-stated objectives, as well as others, as may be determined by a fair reading and interpretation of the entire specification.

A female electrical cord plug or wall outlet is provided for fastening to a male electric cord plug having at least one prong, where the at least one prong has a longitudinal axis and at least one dent, including at least one prong receiving opening having a longitudinal axis along which the prong receiving opening receives the at least one prong, a prong engaging mechanism in the form of at least one dent engaging member which can enter the prong receiving opening and engage the dent, where the dent engaging member can exit the prong receiving opening and disengage the dent and where the dent engaging member includes a shaft positioned essentially perpendicular to the longitudinal axis of the prong receiving opening and a cantilever structure having two ends and attached at one end to the shaft to protrude laterally from the shaft, the shaft being positioned to pass adjacent to the prong receiving opening, the shaft being slidable relative to the prong receiving opening such that the laterally protruding cantilever structure enters and exits the prong receiving opening to engage and disengage the dent by sliding the shaft.

BRIEF DESCRIPTION OF THE DRAWINGS

Various other objects, advantages, and features of the invention will become apparent to those skilled in the art from the following discussion taken in conjunction with the following drawings, in which:

1.

2.

3.

4.

5. FIG. 5 is a perspective view of the spring-loaded latching device of-e second preferred embodiment and the prong having the engaging hole alternative, the latching device having the alternative parallel pin mounted on the tab for entering the hole in the prong. A portion of the guide cut is away to reveal the spring. This pin option can also be applied to the two-button, manual version.

6.

7. FIG. 7 is a perspective view of a dummy male plug for inserting into a female electric cord plug or a wall outlet equipped with the inventive latching device to prevent access to the prong receiving openings.

DETAILED DESCRIPTION OF THE PREFERRED EMBODIMENTS

Figure 1:
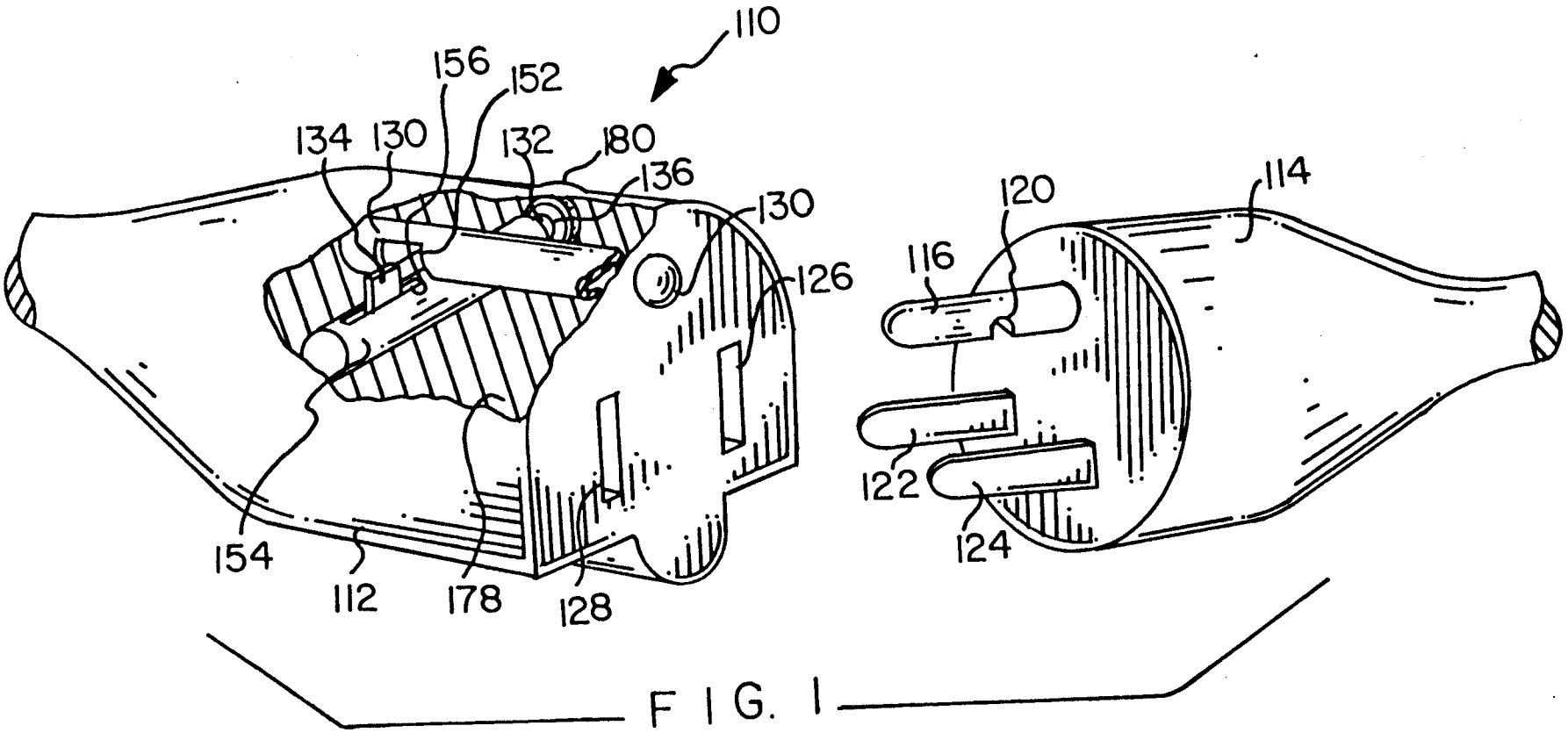
FIG. 1 is a perspective view of three-prong male and female electric cord plugs equipped with the second embodiment of the inventive apparatus, with a portion of the female plug cut away to reveal the latching device.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

Preferred Embodiments

A plug fastening device is disclosed for joining a male electric cord plug having protruding prongs with a female electric cord plug or wall outlet having prong receiving channels. One prong of the male plug is provided with a notch. The female plug or wall outlet has a prong engaging member which can enter and retract from the channel for the one prong. When the prong is in the channel, the engaging member can engage and disengage the prong notch through the channel. See FIGS. 1-7 generally. To use the device, the engaging member is retracted from the channel, the prong is inserted into the channel, and then the engaging member is moved to enter the channel and engage the notch. The prong can be withdrawn from the channel only by first retracting the engaging member from the notch.

Alternatives to the notch are a hole, a dimple or a slot in the prong for receiving the engaging member.

It is preferred that only the ground prong receive an engaging member to eliminate the chance of an electric shock to the user. However, a current carrying prong may be engaged instead if the engaging mechanism is covered by a layer of insulating material.

First Preferred Embodiment

Figure 2:
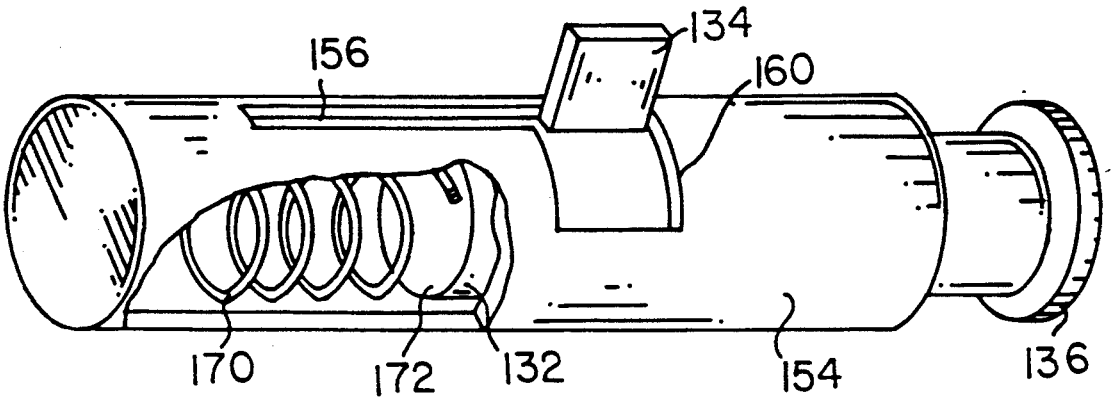
FIG. 2 is a perspective view of the spring loaded latching device of the second preferred embodiment only, having the optional tab-receiving recess, with a portion of the guide cut away to reveal the spring.
Figure 3:
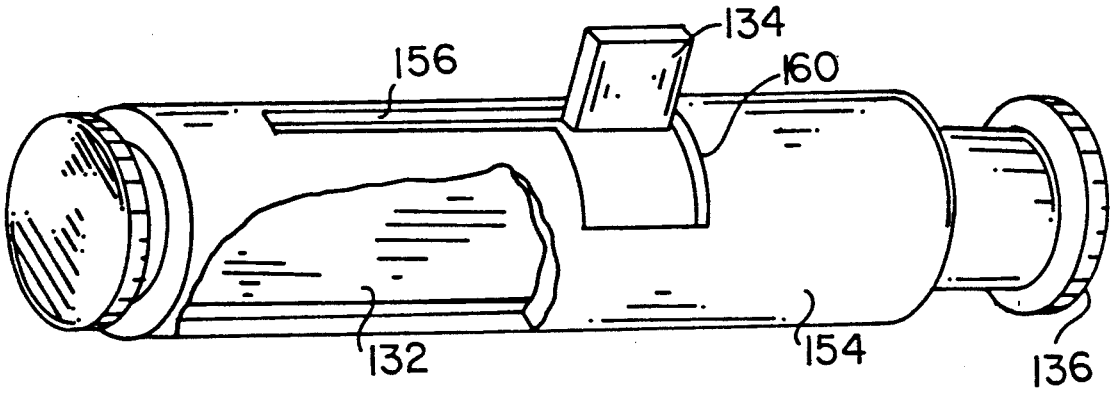
FIG. 3 is a perspective view of the two-button, manual latching device of the second preferred embodiment only, having the optional tab-receiving recess, with a portion of the guide cut away to reveal the shaft.

Referring to FIGS. 1 and 2, the first preferred embodiment installed in a common three-prong plug set is illustrated. A latching assembly 110 is contained within the female plug 112 and the male plug 114 has a ground prong 116 with a notch 120. Prong 116 is of essentially circular cross-section and the remaining prongs 122 and 124 are flat strips.

Prongs 122 and 124 fit into channels 126 and 128 respectively, and prong 116 fits into channel 130 in female plug 112. Channel 130 is a metal tube of a diameter which snugly fits around prong 116.

A resilient plug material 178 such as rubber surrounds latching assembly 110 so that the only apparent difference between female plug 112 and an ordinary plug is a slight bulge 180 over button end 136. To operate latching assembly 110, one simply depresses bulge 180.

Latching assembly 110 is preferably made an integral part of the female plug or outlet during manufacture, but may also be added thereafter.

For this embodiment, the engaging member is a projecting tab 134 on a sliding shaft 132. Shaft 132 is mounted within female plug 112 perpendicular and adjacent to a channel 130 for prong 116. Tab 134 slides into a slot 152 in channel 130. Notch 120 is positioned on prong 116 such that notch 120 can receive tab 134 when tab 134 slides into slot 152. Shaft 132 is preferably contained within a tubular guide 154 having an opening 156 through which tab 134 extends and can slide. Guide 154 prevents high friction contact with the plug material 178 and prevents shaft 132 and tab 134 from rotating relative to channel 130. A coil spring 170 is preferably contained within guide 154 and bears against spring end 172 of shaft 132. Spring 170 biases shaft 132 axially within guide 154. The other end of shaft 132 spreads to form a button 136. This spring biasing holds tab 134 within channel slot 152 to prevent insertion or removal of prong 116 without depressing button 136. A layer of plug material 178 preferably extends over button 136 so that all that can be seen of latching assembly 110 is slight bulge 180. Depressing bulge 180 operates latching assembly 110.

An alternative to spring 170 is a second button **136*a* at spring end 172 covered by material 178 to form a second bulge 180*a*. For this arrangement tab 134** is pushed both into and out of a locking position manually. See FIG. 3.

Latchinq assembly 110 as described above prevents entry as well as withdrawal of prong 116 unless button 136 is pushed. As mentioned for the first embodiment, this arrangement is desirable where very young children have access to plugs 112 and 114. Yet for other circumstances it is more convenient for prong 116 to enter channel 130 freely, without the need to push button 136. The only desired action of the fastening device is to keep plugs 112 and 114 from separating when they are in use. For these purposes, opening 156 in guide 154 is widened adjacent the location of tab 134 in its locking position. See FIGS. 2 and 3. This widened portion of opening 156 is hereinafter referred to as recess 160.

As prong 116 enters channel 130 the end of prong 116 bears against tab 134. Spring 170 not only biases shaft 132 toward bulge 180, it also biases shaft 132 against rotation relative to guide 154. The pressure of prong 116 against tab 134 overcomes this rotational biasing, rotating shaft 132 and pushing tab 134 into recess 160. Slot 152 is wide enough that tab 134 can pivot through ninety degrees within slot 152. Notch 120 is wide enough that, when it slides adjacent shaft 132, tab 134 springs around into notch 120. Recess 160 permits tab 134 to rotate in one direction to permit insertion of prong 116. Yet there is no corresponding recess on the other side of opening 156 for tab 134 to rotate the other way. Thus tab 134 bears against the edge 166 of opening 156 and blocks the withdrawal of prong 116 until button 136 is depressed to slide tab 134 out of notch 120.

Additional Embodiments

It is to be understood that this invention is not limited to the use of an existing or functional plug prong. A dummy prong may be provided on the male or female plug and received by a channel and latching mechanism in the mating plug or wall outlet. As noted above, it is contemplated that a resilient prong may resiliently spring into engagement with a stationary engaging member and disengage by being laterally pushed out of engagement by the user.

Figure 4:
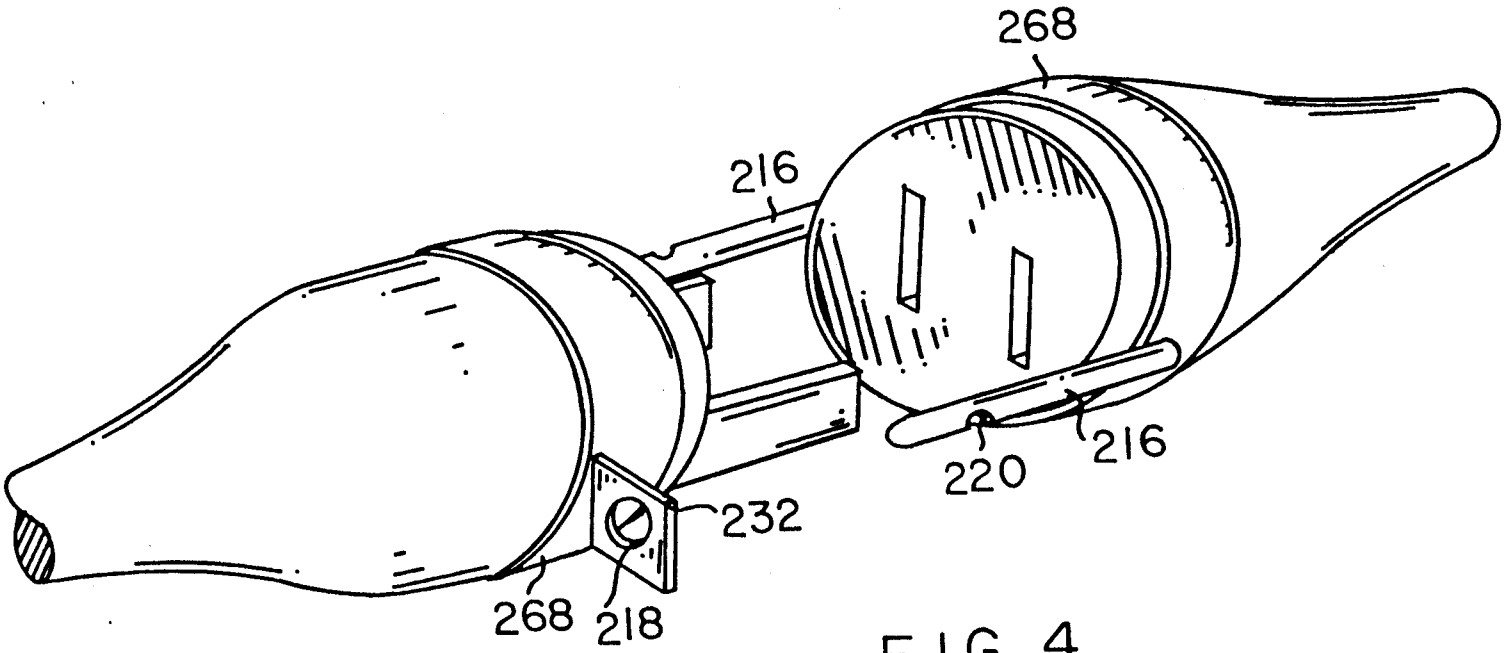
FIG. 4 is a perspective view of two-prong male and female electric cord plugs equipped with an alternative embodiment of the inventive apparatus, wherein dummy prongs are attached to a strap fastened to one plug and prong engaging ears are attached to another strap fastened to the other plug.

For example, resilient, dummy prongs 216 and stationary engagement members are illustrated in FIG. 4. In this instance, engagement members are ears 232 projecting from the sides of a plug. Ears 232 have holes 218 for receiving dummy prongs 216, and the notches 220 in dummy prongs 216 engage the edges of holes 218. Dummy prongs 216 and ears 232 are each mounted to plugs on attaching straps 268.

More than one prong may be engaged by one or more latch mechanisms. More than one notch or equivalent may be provided and engaged on a single prong.

There may be special circumstances where it is desired to permanently secure a male plug into a female plug or outlet. For such circumstances, a plug fastener as set forth in the first, second, and alternative embodiments is contemplated wherein the button or button end part of the latching device for releasing the at least one prong is omitted.

FIG. 5 illustrates a pin 186 mounted on a tab parallel to shaft 132 for entering a hole 188 in prong 116. Pin 186 may alternatively be coaxially mounted at an end of shaft 132. This illustrates the interchangeability of the prong notch and prong hole alternatives.

Figure 6:
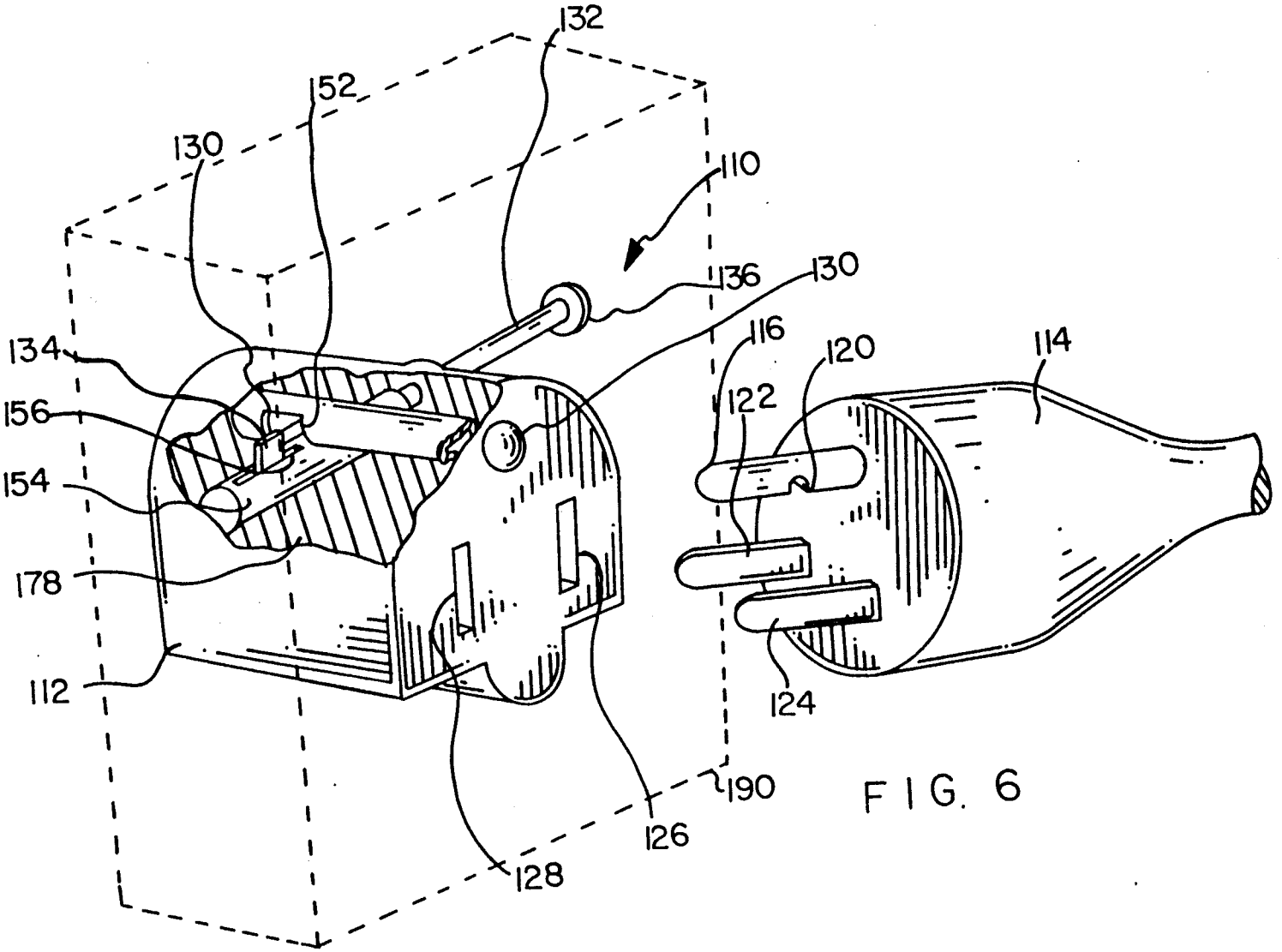
FIG. 6 is a perspective view of three-prong male electric cord plug and wall outlet equipped with the second embodiment of the inventive apparatus, with the housing of the outlet shown in broken lines and with a portion of the outlet receiving apparatus cut away to reveal the latching device.

FIG. 6 illustrates latching assembly 110 of the second embodiment installed in a wall outlet 190.

FIG. 7 illustrates a dummy male plug 214 having a notched prong 216 which can be inserted and locked into outlet 190 to prevent children from gaining access to outlet channels. Dummy male plug 214 must be electrically nonconductive and is preferably formed of a hard, durable plastic. As in all instances above described, notch 220 in prong 216 alternatively can be a hole.

Although three-prong plugs and outlets are illustrated for the various embodiments, it is to be understood that the invention is not limited thereto. The present invention is applicable to plugs and outlets with any other number of prongs, such as the common two-prong variety. The latching mechanisms described above and illustrated in the drawings can be used without alteration and in the manner described on such plugs and outlets.

Method

In practicing the invention, the following method may be used. At least one plug prong 116 having at least one notch or hole 120 is inserted into a receiving channel 130 in a female plug 112 or a wall outlet 190. A engaging member is inserted through a wall of channel 130 into the at least one notch or hole 120.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A female electric cord plug for fastening to a male electric cord plug having at least one prong, wherein said at least one prong has a longitudinal axis and at least one cut out portion, comprising:

at least one prong receiving opening having a longitudinal axis along which said prong receiving opening receives said at least one prong, prong engaging means in the form of at least one cut out portion engaging member which can enter said prong receiving opening and engage said cut out portion, wherein said cut out portion engaging member can exit said prong receiving opening and disengage said cut out portion and wherein said cut out portion engaging member comprises a slidable shaft positioned essentially perpendicular to said longitudinal axis of said prong receiving opening and a cantilever structure having two ends and being cantilevered from said shaft to protrude laterally from said shaft, said shaft being positioned to pass adjacent to said prong receiving opening, said shaft being slidable substantially axially relative to said prong receiving opening such that said laterally protruding cantilever structure enters and exits said prong receiving opening to engage and disengage said cut out portion by sliding said shaft.

2. A female electric cord plug as in claim 1 for fastening to said male electric cord plug wherein said at least one cut out portion is a hole in said prong.

3. A female electric cord plug as in claim 2, wherein the at least one laterally protruding cantilever structure can retract from the at least one prong receiving opening and disengage the at least one hole.

4. A female electric cord plug as in claim 3, wherein said laterally protruding cantilever structure a shaft having an parallel protruding portion, said shaft being positioned to pass adjacent to the at least one opening, said shaft being slidable relative to said at least one opening such that said parallel protruding portion can slide into and out of said at least one opening by sliding said shaft.

5. A female electric cord plug as in claim 4, wherein said shaft is biased to slide to a position which places said parallel protruding portion within said at least one opening.

6. An apparatus as in claim 2, wherein the male electric cord plug has at least two prongs, and at least one of the prongs is a dummy prong which does not carry electric current.

7. An apparatus as in claim 6, wherein the male electric cord plug is not connected to a cord and functions as a dummy plug to prevent access to the at least one prong receiving opening.

8. A female electric cord plug as in claim 1 wherein said cut out portion in said prong is a notch, and said cut out portion engaging member is a notch engaging member, and said radially protruding cantilever structure engages said at least one prong by sliding into said notch and disengages said at least one prong by sliding out of said notch.

9. A female electric cord plug as in claim 8, wherein the shaft is biased to slide to a position which places the laterally protruding cantilever structure within the at least one opening.

10. An apparatus as in claim 8, wherein the male electric cord plug has at least two prongs, and at least one of the prongs is a dummy prong which does not carry electric current.

11. An apparatus as in claim 10, wherein the male electric cord plug is not connected to a cord and functions as a dummy plug to prevent access to the at least one prong receiving opening.

12. A wall outlet for fastening to a male electric cord plug having at least one prong, wherein said at least one prong has a longitudinal axis and at least one cut out portion, comprising:

at least one prong receiving opening having a longitudinal axis along which said prong receiving opening receives said at least one prong, prong engaging means in the form of at least one cut out portion engaging member which can enter said prong receiving opening and engage said cut out portion, wherein said cut out portion engaging member can exit said prong receiving opening and disengage said cut out portion and wherein said cut out portion engaging member comprises a slidable shaft positioned essentially perpendicular to said longitudinal axis of said prong receiving opening, and a cantilever structure having two ends and being cantilevered from said shaft to protrude laterally from said shaft, said shaft being positioned to pass adjacent to said prong receiving opening, said shaft being slidable substantially axially relative to said prong receiving opening such that said laterally protruding cantilever structure enters and exits said prong receiving opening to engage and disengage said cut out portion by sliding said shaft.

13. A wall outlet as in claim 12 for fastening to said male electric cord plug wherein said at least one cut out portion is a hole in said prong.

14. A wall outlet as in claim 13, wherein the at least one laterally protruding cantilever structure can retract from the at least one prong receiving opening and disengage the at least one hole.

15. A wall outlet as in claim 12, wherein said cut out portion in said prong is a notch, and said cut out portion engaging member is a notch engaging member, and said radially protruding cantilever structure engages said at least one prong by sliding into said notch and disengages said at least one prong by sliding out of said notch.

16. A wall outlet as in claim 15, wherein said shaft is biased to slide to a position which places said laterally protruding cantilever structure within said at least one opening.

17. An apparatus as in claim 15, wherein the male electric cord plug has at least two prongs, and at least one of the prongs is a dummy prong which does not carry electric current

18. An apparatus as in claim 17, wherein the male electric cord plug is not connected to a cord and functions as a dummy plug to prevent access to the at least one prong receiving opening.

19. An apparatus as in claim 13, wherein the male electric cord plug has at least two prongs, and at least one of the prongs is a dummy prong which does not carry electric current.

20. An apparatus as in claim 19, wherein the male electric cord plug is not connected to a cord and functions as a dummy plug to prevent access to the at least one prong receiving opening.

21. A female electric cord plug as in claim 1 for fastening to said male electric cord plug wherein said at least one cut out portion is a notch, comprising:

wherein said cantilever structure engages said notch by entering said notch, and wherein said shaft is biased to slide into a position in which said cantilever structure enters said notch.

22. A wall outlet as in claim 12 for fastening to said male electric cord plug wherein said at least one cut out portion is a notch, comprising:

wherein said cantilever structure engages said notch by entering, said notch, and wherein said shaft is biased to slide into a position in which said cantilever structure enters said notch.

23. A female electric cord plug as in claim 1 for fastening to said male electric cord plug wherein said at least one cut out portion is a notch in said prong.

24. A female electric cord plug as in claim 23, wherein said cut out portion engaging cantilever structure can retract from said prong receiving opening and disengage said notch.

25. A wall outlet as in claim 12 for fastening to said male electric cord plug wherein said at least one cut out portion is a notch in said prong.

26. A female electric cord plug as in claim 8, wherein said laterally protruding cantilever structure can retract from the at least one prong preceiving opening and disengage the at least one notch, and wherein said laterally protruding cantilever structure comprises a shaft having a laterally protruding cantilever structure, the shaft being positioned to pass adjacent to the at least one opening, the shaft being slidable relative to the at least one opening such that the laterally protruding cantilever structure can slide into and out of the at least one opening by sliding the shaft.

27. A female electric cord plug as in claim 26, wherein the shaft is biased to slide to a position which places the laterally protruding cantilever structure within the at least one opening.

28. A female electric cord plug as in claim 27, wherein the shaft is rotationally biased such that the axis of the laterally protruding cantilever structure remains perpendicular to the axis of the at least one opening, and when the at least one prong bears against the laterally protruding cantilever structure, the laterally protruding cantilever structure pivots against the biasing about the shaft to permit entry of the at least one prong into the at least one opening, and when the notch passes adjacent to the laterally protruding cantilever structure, the laterally protruding cantilever structure pivots into the notch as a result of the biasing, and the laterally protruding cantilever structure is blocked against rotation about the shaft in the direction of the entrance to the opening.

29. A wall outlet as in claim 25, wherein said laterally protruding cantilever structure can retract from the at least one prong receiving opening and disengage the at least one notch, and wherein said laterally protruding cantilever structure comprises a shaft having a laterally protruding cantilever structure, said shaft being positioned to pass adjacent to the at least one opening, said shaft being slidable relative to said at least one opening such that said laterally protruding cantilever structure can slide into and out of said at least one opening by sliding said shaft.

30. A wall outlet as in claim 29, wherein said shaft is biased to slide to a position which places said laterally protruding cantilever structure within said at least one opening.

31. A wall outlet as in claim 30, wherein the shaft is biased such that the axis of the laterally protruding cantilever structure remains perpendicular to the axis of the at least one opening, and when the at least one prong bears against the laterally protruding cantilever structure, the laterally protruding cantilever structure pivots against the biasing about the shaft to permit entry of the at least one prong into the at least one opening, and when the notch passes adjacent to the laterally protruding cantilever cantilever structure is blocked against rotation about the shaft in the direction of the entrance to the opening.

32. A female electric cord plug for fastening to a male electric cord plug having at least prong, wherein said at least one prong has a longitudinal axis and at least one dent, comprising:

at least one prong receiving opening having a longitudinal axis along which said prong receiving opening receives said at least one prong, prong engaging means in the form of at least one dent engaging member which can enter said prong receiving opening and engage said dent, wherein said dent engaging member can exit said prong receiving opening and disengage said dent and wherein said dent engaging member comprises a slidable shaft positioned essentially perpendicular to said longitudinal axis of said prong receiving opening and a cantilever structure having two ends and attached at one said end to said shaft to protrude laterally from said shaft, said shaft being positioned to pass adjacent to said prong receiving opening, said shaft being slidable substantially axially relative to said prong receiving opening such that said laterally protruding cantilever structure enters and exits said prong receiving opening to engage and disengage said dent by sliding said shaft.

33. A wall outlet for fastening to a male electric cord plug having at least one prong, wherein said at least one prong has a longitudinal axis and at least one dent, comprising:

At least one prong receiving opening having a longitudinal axis along which said prong receiving opening receives said at least one prong, prong engaging means in the form of at least one dent engaging member which can enter said prong receiving opening and engage said dent, wherein said dent engaging member can exit said prong receiving opening and disengage said dent and wherein said dent engaging member comprises a slidable shaft positioned essentially perpendicular to said longitudinal axis of said prong receiving opening and a cantilever structure having two ends and attached at one said end to said shaft to protrude laterally from said shaft, said shaft being positioned to pass adjacent to said prong receiving opening, said shaft being slidable substantially axially relative to said prong receiving opening such that said laterally protruding cantilever structure enters and exits said prong receiving opening to engage and disengage said dent by sliding said shaft.

34. A female electric cord plug for fastening to a male electric cord plug having at least one prong, wherein the at least one prong has at least one notch, comprising:

At least one prong receiving opening having a longitudinal axis along its depth, prong engaging means in the form of at least one notch engaging member which can enter the at least one prong receiving opening and engage the at least one notch, wherein the at least one notch engaging member can retract from the at least one prong receiving opening and disengage the at least one notch and wherein the at least one notch engaging member comprises a shaft having a radially protruding member, the shaft being positioned to pass adjacent to the at least one opening, the shaft being slidable relative to the at least one opening such that the radially protruding member can slide into and out of the at least one opening by sliding the shaft, wherein the shaft is biased to slide to a position which places the radially protruding member within the at least one opening and wherein the shaft is rotationally biased such that the axis of the radially protruding member remains perpendicular to the axis of the at least one opening, and when the at least one prong bears against the radially protruding member, the radially protruding member pivots against the biasing about the shaft to permit entry of the at least one prong into the at least one opening, and when the notch passes adjacent to the radially protruding member, the radially protruding member pivots into the notch as a result of the biasing, and the radially protruding member is blocked against rotation about the shaft in the direction of the entrance to the opening.

35. A wall outlet for fastening to a male electric cord plug having at least one prong, comprising:

at least one prong receiving opening and prong engaging anchoring means, wherein the at least one prong has at least one notch, comprising prong engaging means in the form of at least one notch engaging member which can enter the at least one prong receiving opening and engage the at least one notch, and wherein the at least one notch engaging member can retract from the at least one prong receiving opening and disengage the at least one notch, wherein the at least one notch engaging member comprises a shaft having a radially protruding member, said shaft being positioned to pass adjacent to the at least one opening, said shaft being slidable relative to said at least one opening such that said radially protruding member can slide into and out of said at least one opening by sliding said shaft, wherein said shaft is biased to slide to a position which places said radially protruding member within said at least one opening, wherein the shaft is biased such that the axis of the radially protruding member remains perpendicular to the axis of the at least one opening, and when the at least one prong bears against the radially protruding member, the radially protruding member pivots against the biasing about the shaft to permit entry of the at least one prong into the at least one opening, and when the notch passes adjacent to the radially protruding member, the radially protruding member pivots into the notch as a result of the biasing, and the radially protruding member is blocked against rotation about the shaft in the direction of the entrance to the opening.

* * * * *